US006610450B2

(12) United States Patent
Yang et al.

(10) Patent No.: US 6,610,450 B2
(45) **Date of Patent: *Aug. 26, 2003**

(54) THERMALLY DEVELOPABLE IMAGING SYSTEM COMPRISING A BLOCKED COLOR-FORMING AGENT IN ASSOCIATION WITH A HYDROXY-SUBSTITUTED AROMATIC COMPOUND FOR PROMOTING IMAGE FORMATION

(75) Inventors: Xiqiang Yang, Webster, NY (US); Zbyslaw R. Owczarczyk, Webster, NY (US); David T. Southby, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/871,921

(22) Filed: Jun. 1, 2001

(65) Prior Publication Data

US 2002/0028412 A1 Mar. 7, 2002

Related U.S. Application Data

(60) Provisional application No. 60/211,296, filed on Jun. 13, 2000.

(51) Int. Cl.[7] ..... G03C 11/00; G03C 5/16; G03C 1/498; G03C 1/005

(52) U.S. Cl. ..... 430/21; 430/350; 430/353; 430/380; 430/404; 430/443; 430/448; 430/566; 430/619; 430/957; 430/958; 430/964

(58) Field of Search ..... 430/21, 350, 353, 430/380, 404, 443, 448, 566, 617, 619, 955, 956, 957, 958, 964

(56) References Cited

U.S. PATENT DOCUMENTS 5,352,561 A 10/1994 Bailey et al.

5,843,618 A 12/1998 Bailey et al.

FOREIGN PATENT DOCUMENTS

EP 0 393 523 A2 10/1990

OTHER PUBLICATIONS

U.S. Ser. No. 09/476,234 filed Dec. 30, 1999, Imaging Element Containing A Blocked Photographically Useful Compound, Z. Owczarczyk et al.

U.S. Ser. No. 09/858,398 filed May 16, 2001, Color Photothermographic Elements Comprising Phenolic Thermal Solvents, Xiqiang Yang et al.

Database WPI Section CH, Week 199510, Derwent Publications Ltd., London, GB; AN 1995–071128, XP002184005 & JP 06 347969 A (Fuji Photo Film Co. Ltd), Dec. 22, 1994, abstract.

*Primary Examiner*—Thorl Chea
(74) *Attorney, Agent, or Firm*—Chris P. Konkol

(57) ABSTRACT

This invention comprises an imaging element comprising an imaging layer having associated therewith a phenolic activating agent in combination with a blocked color-forming agent of Structure I:

I wherein PUG is a photographically useful color-forming agent, LINK 1 and LINK 2 are linking groups; TIME is a timing group; HET is a heterocyclic group, and the other groups are as defined in the specification.

33 Claims, No Drawings

THERMALLY DEVELOPABLE IMAGING SYSTEM COMPRISING A BLOCKED COLOR-FORMING AGENT IN ASSOCIATION WITH A HYDROXY-SUBSTITUTED AROMATIC COMPOUND FOR PROMOTING IMAGE FORMATION

This application claims the benefit of Provisional Application No. 60/211,296 filed Jun. 13, 2000.

FIELD OF THE INVENTION

This invention relates to an imaging element containing a specific type of blocked developer or preformed dye and a phenolic or other hydroxy-substituted aromatic compound for activating the unblocking of the developer or dye.

BACKGROUND OF THE INVENTION

Conventional color photography employs a light sensitive silver halide containing films suitable for use in hand-held cameras, which film upon exposure carries a latent image that is revealed after suitable processing. Such film has historically been processed by treating the camera-exposed film with a developing agent that acts to form image. The well known chromogenic dye-forming films employ p-aminophenols or p-phenylenediamine developing agents (reducing agents) to form dye images. Traditionally, these reducing agents are typically present in developer solutions that are then brought into reactive association with exposed photographic film at the time of processing. Segregation of the developer and the film element has been necessary because the incorporation of developing agent directly into sensitized photographic elements frequently leads to desensitization of the silver halide emulsion and undesirable fog. Considerable effort has therefore been directed at trying to produce effective blocked developers, which can be introduced in silver halide emulsion elements without deleterious desensitization or fog effects and which unblock under conditions of development so that the developing agent is free to participate in image-forming (dye or silver metal forming) reactions.

U.S. Pat. No. 3,342,599, to Reeves, discloses the use of Schiff base developer precursors. Schleigh and Faul, in a *Research Disclosure* (129 (1975) pp. 27–30), described the quaternary blocking of color developing agents and the acetamido blocking of p-phenylenediamines. (All Research Disclosures referenced herein are published by Kenneth Mason Publications, Ltd., Dudley Annex, 12a North Street, Emsworth, Hampshire P010 7DQ, ENGLAND). Subsequently, U.S. Pat. No. 4,157,915, to Hamaoka et al., and U.S. Pat. No. 4, 060,418, to Waxman and Mourning, describe the preparation and use of blocked p-phenylenediamines in an image-receiving sheet for color diffusion transfer. Blocked developing agents involving β-elimination reactions during unblocking have been disclosed in European Patent Application 393523 and kokais 57076453; 2131253; and 63123046, the latter specifically in the context of photothermographic elements.

All of these approaches have failed in practical product applications because of one or more of the following problems: desensitization of sensitized silver halide; unacceptably slow unblocking kinetics; instability of blocked developer yielding increased fog and/or decreased Dmax after storage, and lack of simple methods of releasing the blocked developer.

U.S. Pat. No. 5,352,561 to Bailey et al. discloses the use of phenolic compounds (hydroxybenzene derivatives) for forming an improved dye image in an aqueous developable photographic dry dye-diffusion transfer element. A color coupler forms or releases a heat-transferable dye upon reaction of the coupler with the oxidation product of a primary amine developing agent. A dye-receiving layer is placed in physical contact with the dye-diffusion transfer element and then combination heated to effect dye-diffusion.

PROBLEM TO BE SOLVED BY THE INVENTION

There is a continuing need for imaging elements, particularly thermographic and photothermographic imaging elements, that contain a developing agent or other color-forming agent that is stable until development, yet can rapidly and easily develop the imaging element once processing has been initiated by heating the element and/or by applying to the imaging element a small volume of processing solution, such as a solution of a base or acid or pure water, in the presence of heat. For rapid access capability of photothermographic film, the developing agent must be in the form of an incorporated blocked developer that is highly reactive so that a great amount of the developing agent can be produced in a short period of time during processing. Such high reactivity must not lead to difficulty in the production and handling of these materials. In general, increased image density formation at lower onset temperatures is desirable, to minimize undesirable effects that tend to occur at higher onset temperatures. The existence of such developer chemistry will allow for very rapidly processed films that can be processed simply and efficiently, proving one-stop photoprocessing or even photoprocessing kiosks.

SUMMARY OF THE INVENTION

This invention is directed to a photothermographic element comprising a combination of (1) a type of blocked developer or other color-forming agent in which the unblocking by a 1,2-elimination reaction is activated by an N-containing heterocyclic moiety, and (2) a hydroxy-substituted aromatic compound, referred to herein as a "phenolic compound", also referred to herein as an "activating agent" that promotes the unblocking of the blocked developing agent or other color-forming agent, thereby facilitating image formation. The two components are in "association," by which is meant that the activating agent must be sufficiently near to the color-forming agent to participate in the unblocking reaction, even though the activating agent is not itself chemically changed in the reaction. It has been found that a blocked color-forming agent in combination with a phenolic compound, in accordance with the present invention, can significantly accelerate the release of the color-forming agent upon heat processing. The use of the claimed combination in a photographic element can, therefore, provide rapid access capability for a photothermographic element at relatively lower temperatures. Solution measurement of the deblocking reaction suggests very slow reaction without phenol catalysis and significant acceleration by phenol catalysis. By bringing the blocked color-forming agent in contact with the phenolic compound only during processing, high stability at storage temperature and reactivity at processing temperature can be achieved. Another result of the interaction between the blocked color-forming agent and the phenolic compound during development is that image formation is improved, including an increase in image-density formation.

The invention additionally relates to a method of image formation having the steps of thermally developing an imagewise exposed photothermographic element having a heteroaromatic moiety that enables release of a developer on thermal activation to form a developed image, scanning said developed image to form a first electronic image representation from said developed image, digitizing said first electronic record to form a digital image, modifying said digital image to form a second electronic image representation, and storing, transmitting, printing or displaying said second electronic image representation.

The invention also relates to thermographic imaging elements and methods of image formation involving release of a developer or preformed dye on thermal activation.

DETAILED DESCRIPTION OF THE INVENTION

As mentioned above, this invention relates to an imaging element containing specific blocked developers or other color-forming agent and a phenolic activating agent. The blocked color-forming agent has a heteroaromatic moiety that enables release of a photographically useful group on thermal activation. In one embodiment, the general structure for the blocked developer is shown below:

(I)

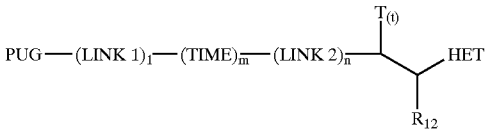

wherein LINK1 and LINK2 are linking groups, TIME is a timing group; HET=heterocyclic group, $T_{(t)}$ and $R_{12}$ are substituents, 1 and n are independently 0 or 1; and m is 0, 1, or 2. In thermal imaging systems, when the blocked PUG ("photographically useful group") is a developer, the blocked compound releases the developer to give useful quantities of chromogenic development when elements containing them are heated.

The general structures for the hydroxy-substituted aromatic compound is Ar—$(OH)_q$, wherein $q \geqq 1$, preferably 1 to 4, more preferably 1, and Ar is a substituted or unsubstituted aromatic group. Some of the phenolic compounds useful in the present invention are also useful as thermal solvents or melt formers in photothermographic systems. See commonly assigned, copending U.S. Ser. No. 60/211,452, hereby incorporated by reference in its entirety. Thus, the phenolic compounds of the present invention can have a dual function, both promoting unblocking as well as providing a solvent for reactants during thermal development. However, imaging elements according to the present invention can comprise conventional melt formers or thermal solvents, including, for example, benzamide, dimethylurea, and many other groups of compounds which provide improved image formation and discrimination. It has been found, however, that the use of conventional benzamide or dimethylurea as a thermal solvent does not significantly improve the image formation characteristics of the film with blocked developers employed in the present invention.

As mentioned above, the phenolic compounds according to the present invention not only contribute to high dye density formation, but also can lower the processing temperature, lending more flexibility to utilizing these blocked compounds in practice.

In one embodiment, thermal activation preferably occurs at temperatures between about 100 and 160° C., preferably to about 140° C. or below, more preferably to about 130° C. or below. In another embodiment, thermal activation preferably occurs at temperatures between about 20 and 100° C. in the presence of added acid, base or water.

The invention, therefore, relates to a light sensitive photothermographic element comprising a support and comprising the blocked developer having a heteroaromatic moiety in combination with a phenolic activator that enables release of the developer on thermal activation.

The linking groups LINK 1 and LINK 2 are independently selected from of Structure II:

(II)

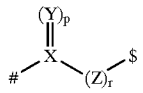

wherein

X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

In structure I, the PUG is a color-forming agent that can be, for example, a photographic dye or a photographic reagent. A photographic reagent herein is a moiety that upon release further reacts with components in the photographic element. Such photographically useful groups include, for example, couplers (such as, image dye-forming couplers, development inhibitor releasing couplers, competing couplers, polymeric couplers and other forms of couplers), development inhibitors, inhibitor releasing developers, dyes and dye precursors, developing agents (such as competing developing agents, dye-forming developing agents, developing agent precursors, and silver halide developing agents). By the term "color-forming agent" is meant that the PUG is involved in the formation of image color or dye density in an imaging layer, either positively increasing color formation or negatively decreasing or limiting color formation.

The PUG can be present in the blocked compound as a preformed species or as a precursor. For example, a preformed development inhibitor may be bonded to the blocking group or the development inhibitor may be attached to a timing group that is released at a particular time and location in the photographic material. The PUG may be, for example, a preformed dye or a compound that forms a dye after release from the blocking group.

In preferred embodiments of the invention the PUG is a developing agent. The developing agent can be a color developing agent, a black-and-white developing agent or a cross-oxidized developing agent. They include aminophenols, phenylenediamines, hydroquinones, pyrazolidinones, and hydrazines. Illustrative developing agents are described in U.S. Pat. Nos. 2,193,015, 2,108,243, 2,592,364, 3,656,950, 3,658,525, 2,751,297, 2,289,367, 2,772,282, 2,743,279, 2,753,256, and 2,304,953, the entire disclosures of which are incorporated herein by reference.

Illustrative PUG groups that are useful as developers are:

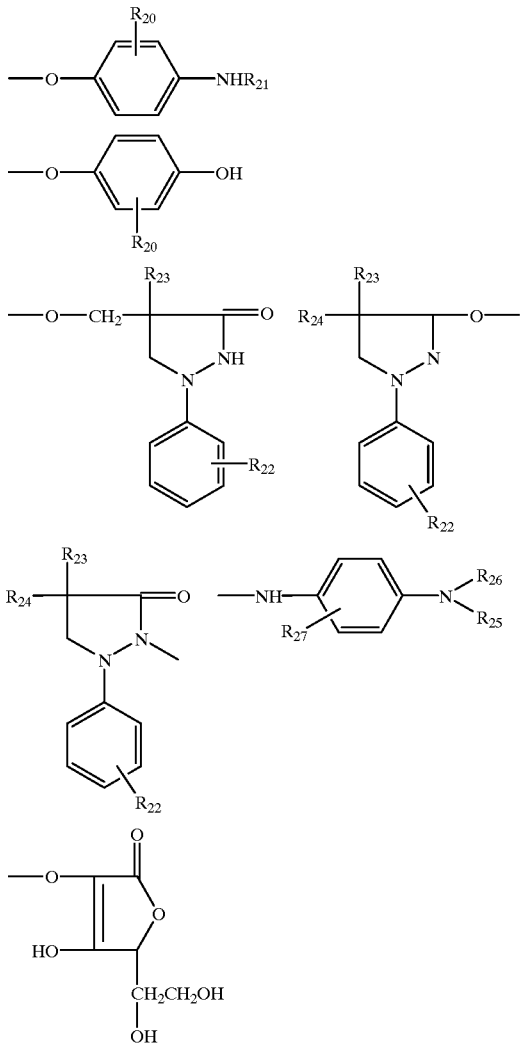

wherein $R_{20}$ is hydrogen, halogen, alkyl or alkoxy;

$R_{21}$ is a hydrogen or alkyl;

$R_{22}$ is hydrogen, alkyl, alkoxy or alkenedioxy; and $R_{23}$, $R_{24}$, $R_{25}$ $R_{26}$ and $R_{27}$ are hydrogen alkyl, hydroxyalkyl or sulfoalkyl.

As mentioned above, in a preferred embodiment of the invention, LINK 1 or LINK 2 are of structure II:

(II)

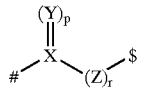

wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

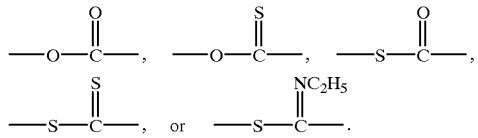

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Illustrative timing groups are illustrated by formulae T-1 through T-4.

(T-1)

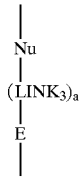

wherein:

Nu is a nucleophilic group;

E is an electrophilic group comprising one or more carbo- or hetero- aromatic rings, containing an electron deficient carbon atom;

LINK 3 is a linking group that provides 1 to 5 atoms in the direct path between the nucleophilic site of Nu and the electron deficient carbon atom in E; and a is 0 or 1.

Such timing groups include, for example:

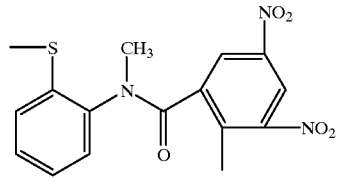

and

-continued

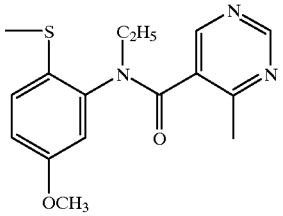

These timing groups are described more fully in U.S. Pat. No. 5,262,291, incorporated herein by reference.

(T-2)

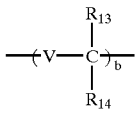

wherein

V represents an oxygen atom, a sulfur atom, or an

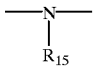

group;

$R_{13}$ and $R_{14}$ each represents a hydrogen atom or a substituent group;

$R_{15}$ represents a substituent group; and b represents 1 or 2.

Typical examples of $R_{13}$ and $R_{14}$, when they represent substituent groups, and $R_{15}$ include

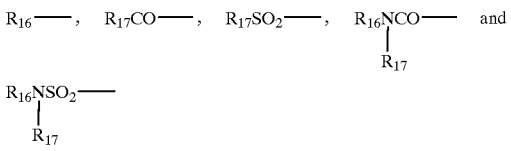

where, $R_{16}$ represents an aliphatic or aromatic hydrocarbon residue, or a heterocyclic group; and $R_{17}$ represents a hydrogen atom, an aliphatic or aromatic hydrocarbon residue, or a heterocyclic group, $R_{13}$, $R_{14}$ and $R_{15}$ each may represent a divalent group, and any two of them combine with each other to complete a ring structure. Specific examples of the group represented by formula (T-2) are illustrated below.

(T-3)

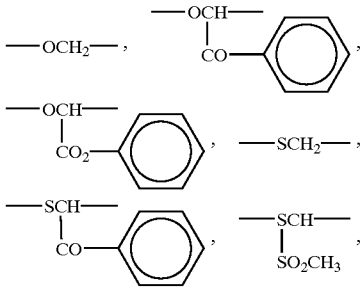

-continued

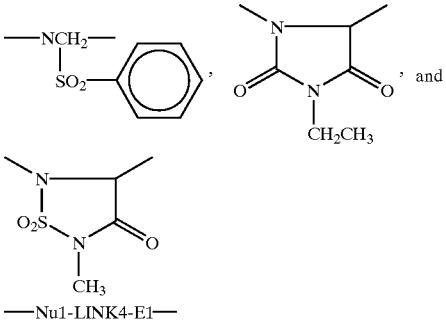

wherein Nu 1 represents a nucleophilic group, and an oxygen or sulfur atom can be given as an example of nucleophilic species; E1 represents an electrophilic group being a group which is subjected to nucleophilic attack by Nu 1; and LINK 4 represents a linking group which enables Nu 1 and E1 to have a steric arrangement such that an intramolecular nucleophilic substitution reaction can occur. Specific examples of the group represented by formula (T-3) are illustrated below.

(T-4)

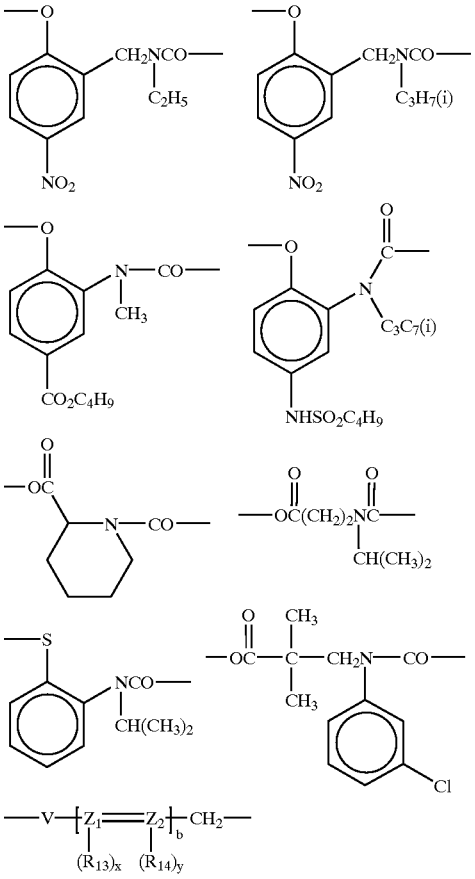

wherein V, $R_{13}$, $R_{14}$ and b all have the same meaning as in formula (T-2), respectively. In addition, $R_{13}$ and $R_{14}$ may be joined together to form a benzene ring or a heterocyclic ring, or V may be joined with $R_{13}$ or $R_{14}$ to form a benzene or heterocyclic ring. $Z_1$ and $Z_2$ each independently represents a carbon atom or a nitrogen atom, and x and y each represents 0 or 1.

Specific examples of the timing group (T-4) are illustrated below.

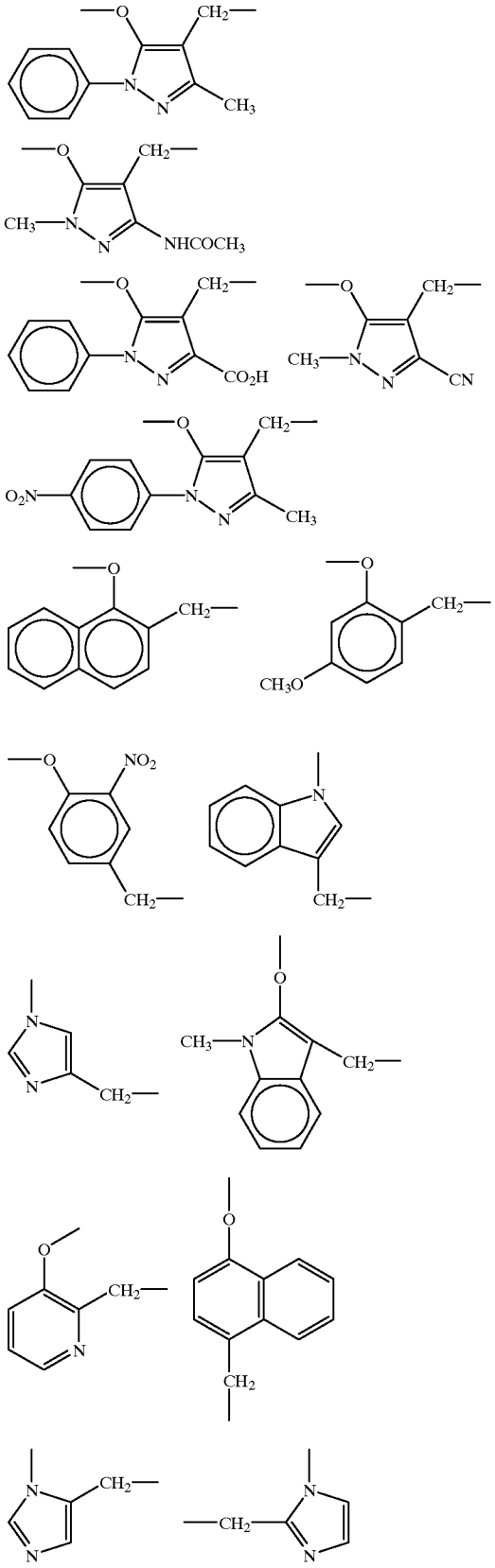

-continued

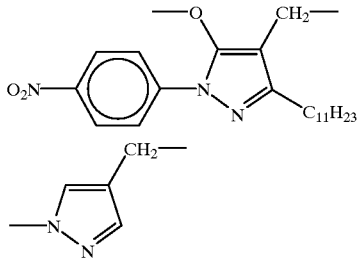

A preferred embodiment of the invention comprises an imaging element comprising an imaging layer having associated therewith a compound of Structure I:

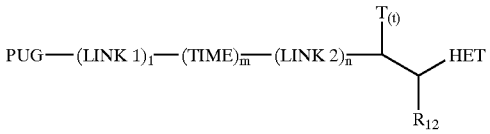

(I)

wherein

PUG is a color-forming agent;

TIME is a timing group as described below;

T represents t independently selected substituted or unsubstituted alkyl (preferably containing 1 to 6 carbon atoms) or aryl groups (preferably phenyl or naphthyl), t is 0, 1, or 2 and if t is 2, the T groups can form a ring;

HET is a heterocyclic group that optionally can form a ring with a T group;

$R_{12}$ is hydrogen, substituted or unsubstituted alkyl or substituted or unsubstituted aryl, or $R_{12}$ can form a ring with a T group or with HET;

l is 0 or 1;

m is 0, 1, or 2; and n is 0 or 1.

HBET is preferably a substituted or unsubstituted 4 or 7-membered ring, preferably a 5 or 6-membered ring, containing one or more heteroatoms, such as N, O, S or Se. Preferably, the heterocyclic (HET) group of Structure I comprises, for example, a substituted or unsubstituted benzimidazolyl, benzothiazolyl, benzoxazolyl, benzothiophenyl, benzofuryl, furyl, imidazolyl, indazolyl, indolyl, isoquinolyl, isothiazolyl, isoxazolyl, oxazolyl, picolinyl, purinyl, pyranyl, pyrazinyl, pyrazolyl, pyridyl, pyrimidinyl, pyrrolyl, quinaldinyl, quinazolinyl, quinolyl, quinoxalinyl, tetrazolyl, thiadiazolyl, thiatriazolyl, thiazolyl, thiophenyl, and triazolyl group. Particularly preferred are: 2-imidazolyl, 2-benzimidazolyl, 2-thiazolyl, 2-benzothiazolyl, 2-oxazolyl, 2-benzoxazolyl, 2-pyridyl, 2-quinolinyl, 1-isoquinolinyl, 2-pyrrolyl, 2-indolyl, 2-thiophenyl, 2-benzothiophenyl, 2-furyl, 2-benzofuryl, 2-, 4-, or 5-pyrimidinyl, 2-pyrazinyl, 3-,4-, or 5-pyrazolyl, 3-indazolyl, 2-(1,3,4-triazolyl), 4-or 5-(1,2,3-triazolyl), 5-(1,2,3,4-tetrazolyl). The heterocyclic group may be further substituted. Preferred substituents are alkyl and alkoxy groups containing 1 to 6 carbon atoms.

Particularly preferred photographically useful compounds are blocked developers of Structure III:

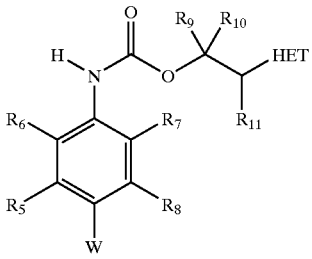

(III)

wherein:

HET is a heterocyclic group;

W is OH or $NR_2R_3$, and $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or $R_6$ and/or $R_8$ can connect to $R_4$ or $R_7$ to form a ring;

$R_9$, $R_{10}$ and $R_{11}$ are independently hydrogen, alkyl, aryl, heteroaromatic or alkoxy groups, or any two of $R_9$, $R_{10}$, $R_{11}$ and HET can be connected to form a ring.

When reference in this application is made to a particular moiety, or group, this means that the moiety may itself be unsubstituted or substituted with one or more substituents (up to the maximum possible number). For example, "alkyl" or "alkyl group" refers to a substituted or unsubstituted alkyl, while "aryl group" refers to a substituted or unsubstituted benzene (with up to five substituents) or higher aromatic systems. Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms), for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched, unbranched or cyclic. By the term "ring" is meant saturated, unsaturated or aromatic rings, preferably having 4 to 10 carbon atoms in the ring.

The following are representative examples of compounds of Structure III:

D-1

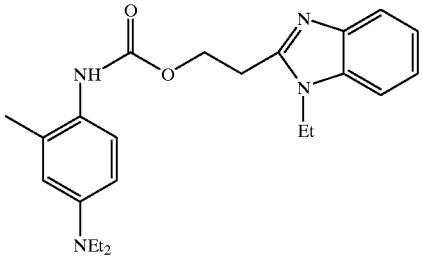

-continued

D-2

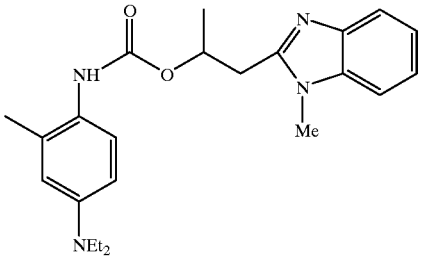

D-3

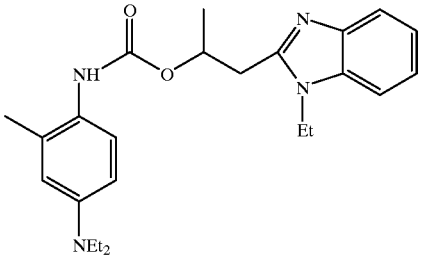

D-4

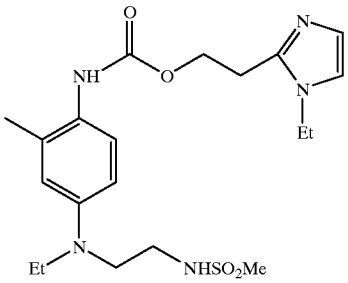

D-5

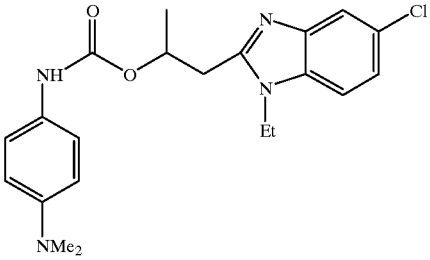

D-6

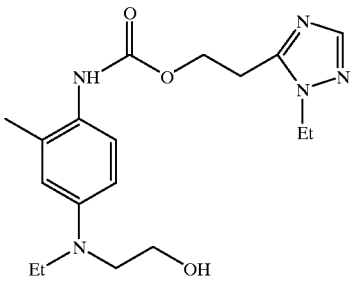

-continued
D-7
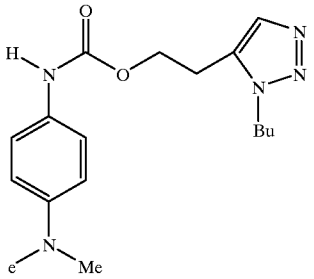
D-8
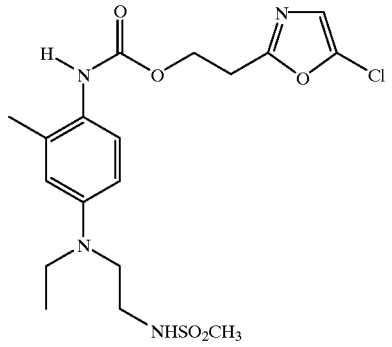
D-9
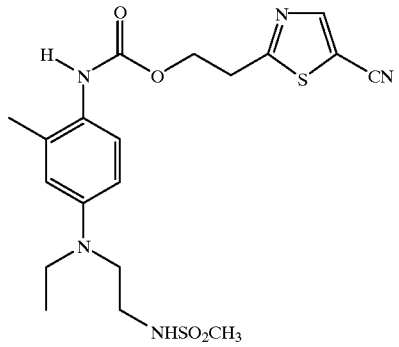
D-10
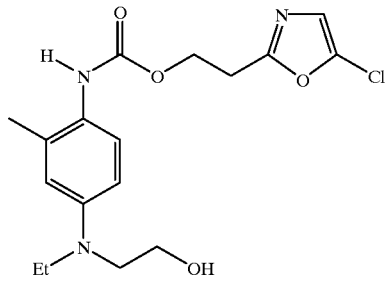
D-11
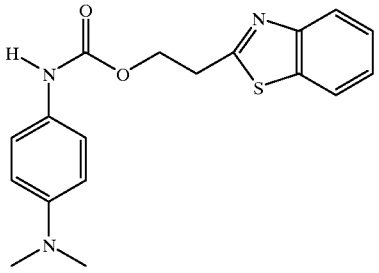
-continued
D-12
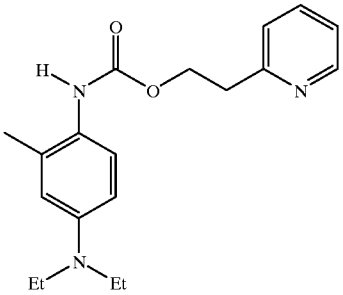
D-13
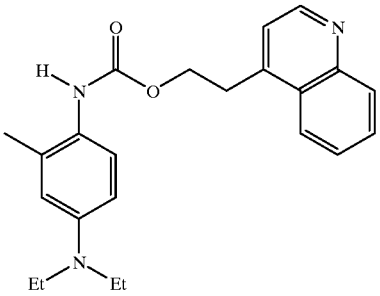
D-14
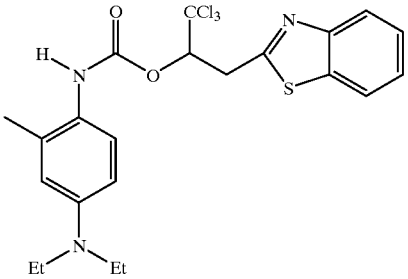
D-15
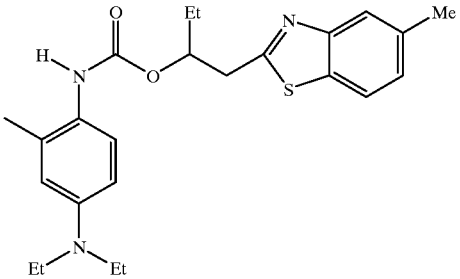
D-16
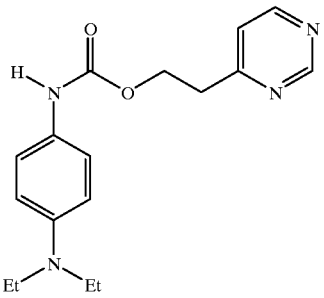

-continued
D-17
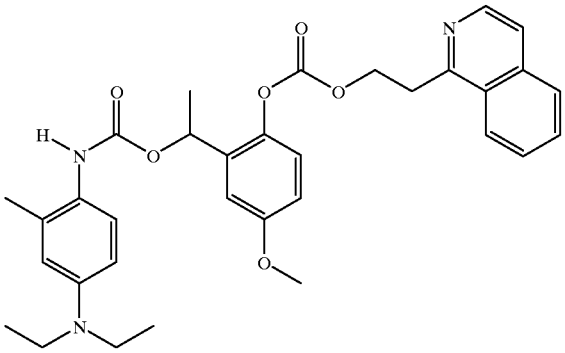
D-18
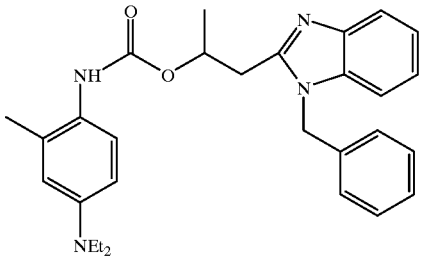
D-19
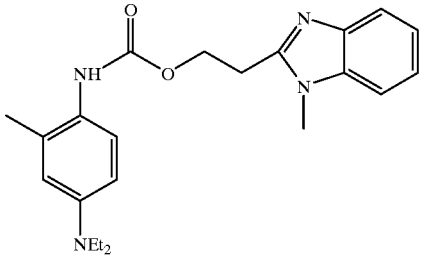
D-20
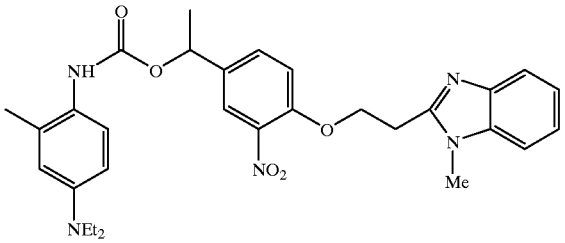
D-21
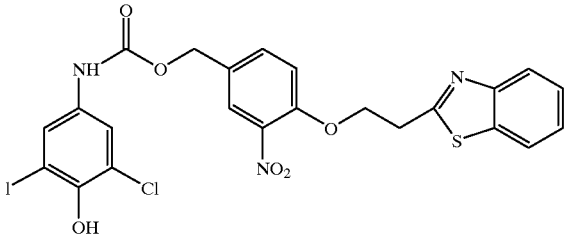
-continued
D-22
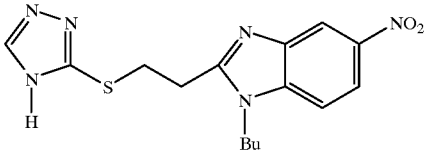
D-23
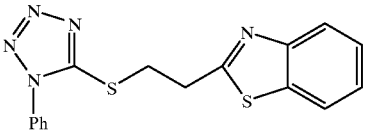
D-24
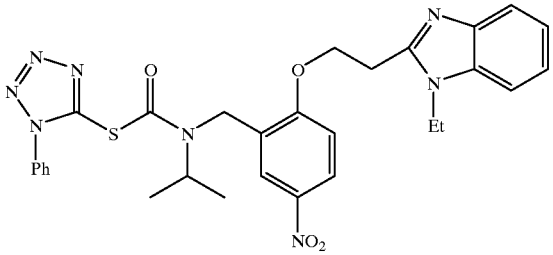
D-25
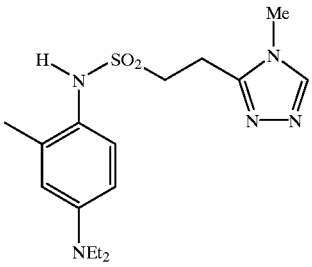
D-26
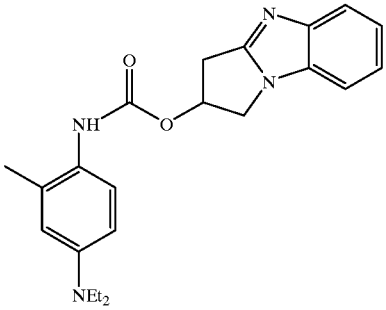
D-27
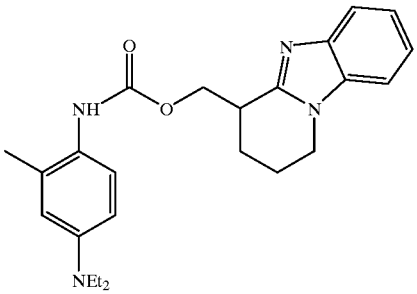

-continued

D-28

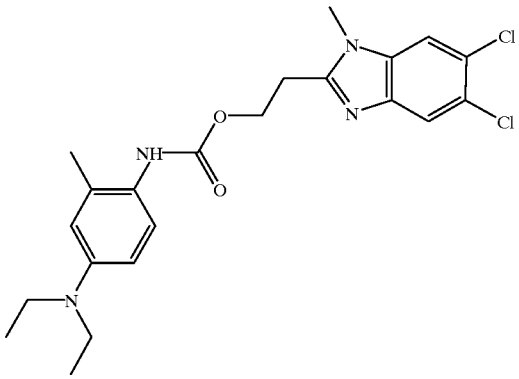

D-29

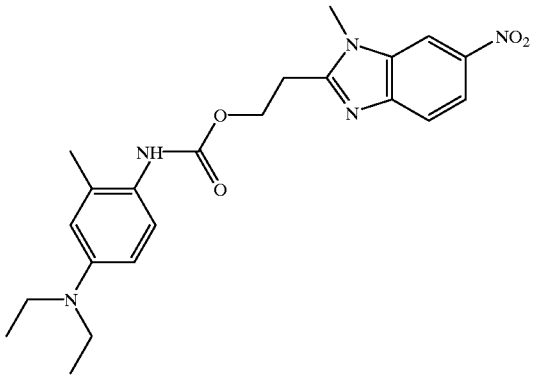

-continued

D-30

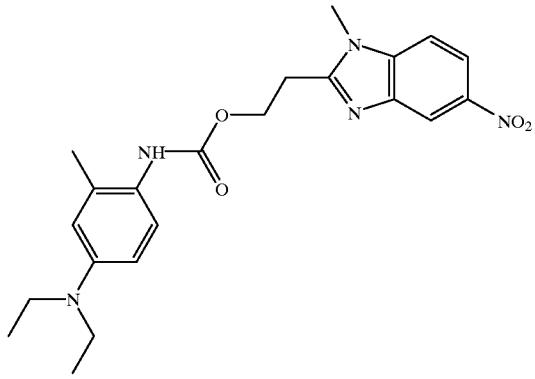

The blocked developer is preferably incorporated in one or more of the imaging layers of the imaging element. The amount of blocked developer used is preferably 0.01 to 5 $g/m^2$, more preferably 0.1 to 2 $g/m^2$ and most preferably 0.3 to 2 $g/m^2$ in each layer to which it is added. These may be color forming or non-color forming layers of the element. The blocked developer can be contained in a separate element that is contacted to the photographic element during processing.

The general structures for the phenolic promoter (IV) is shown below:

$$Ar—(OH)_q \qquad IV$$

wherein $q \geqq 1$ and Ar is a substituted or unsubstituted aromatic group, preferably a phenyl ring. Preferably q is 1 or 2.

Representative examples of Phenolic compounds according to the present invention are as follows:

| ID | Structure |
|---|---|
| A-1 | 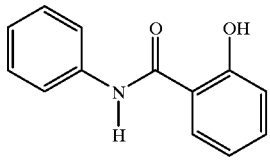 |
| A-2 | 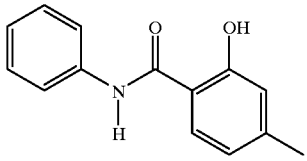 |
| A-3 | 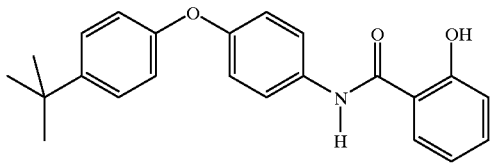 |

-continued
| ID | Structure |
|---|---|
| A-4 | 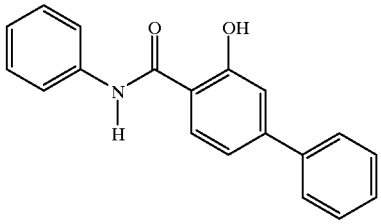 |
| A-5 | 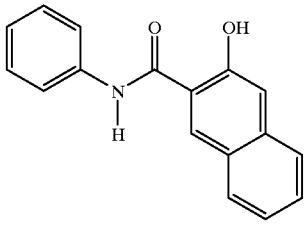 |
| A-6 | 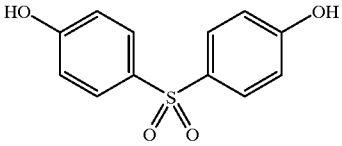 |
| A-7 | 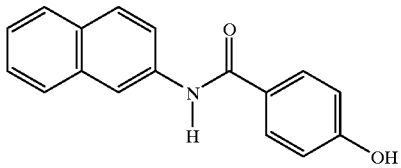 |
| A-8 | 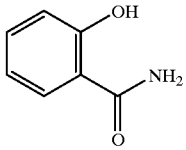 |
| A-9 | 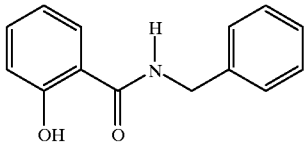 |
| A-10 | 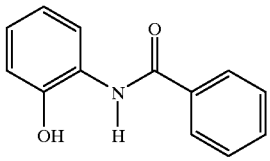 |
| A-11 | 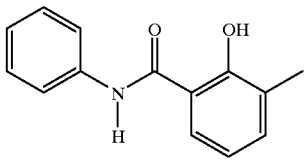 |

-continued
| ID | Structure |
|---|---|
| A-12 | 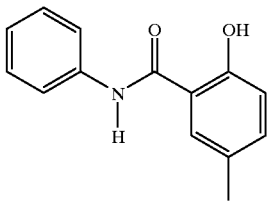 |
| A-13 | 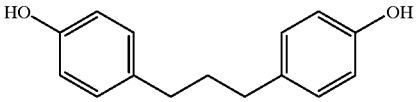 |
| A-14 | 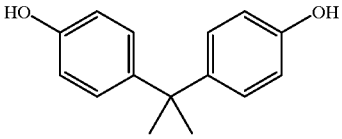 |
| A-15 | 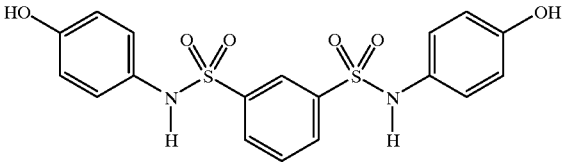 |
| A-16 | 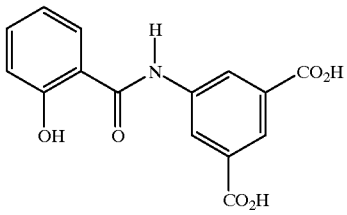 |
| A-17 | 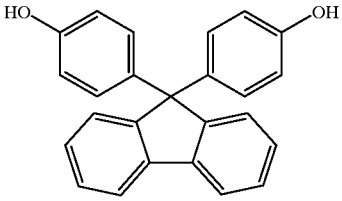 |
| A-18 | 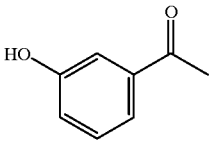 |
| A-19 | 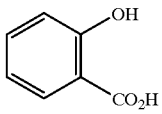 |

-continued

| ID | Structure |
|---|---|
| A-22 | 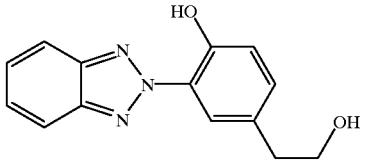 |
| A-23 | 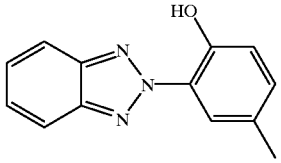 |

The melting points of the phenolic compounds above are listed below:

| ID | Melting point, ° C. |
|---|---|
| A-1 | 134 |
| A-2 | 191 |
| A-3 | 159 |
| A-4 | 208 |
| A-5 | 248 |
| A-6 | 248 |
| A-7 | NA* |
| A-8 | 159 |
| A-9 | NA |
| A-10 | NA |
| A-11 | 117 |
| A-12 | 160 |
| A-13 | 102 |
| A-14 | 158 |
| A-15 | 193 |
| A-16 | >325 |
| A-17 | 224 |
| A-18 | 93 |
| A-19 | NA |
| A-22 | 120–123 |
| A-23 | 128–133 |

*NA = not available

Preferably, the activating compounds employed in our invention have a phenolic-OH group that is weakly acidic characterized by a low $pK_a$ value. By "phenolic" is meant that the —OH group is a substituent on an aromatic ring. Phenolic compounds in which there is ortho substitution adjacent the hydroxy group is also preferred, particularly when it contributes to the acidity of the hydroxy group. Preferably, the substituents are electron withdrawing on the aromatic ring. Preferably, the pKa is less than 10, more preferably 6 to 9.5, most preferably about 8–9.

In one particular embodiment, an activating agent is including according to the following Structure V:

(V)

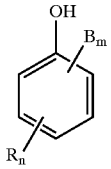

wherein B is selected from the group consisting of —C(=O)NHR$^3$, —NHC(=O)R$^3$, —NHSO$_2$R$^3$, —C(=O)R$^3$, —C(=O)OR$^3$, —OR$^3$, —SO$_2$NHR$^3$, and —SO$_2$R$^3$is hydrogen or substituted or unsubstituted alkyl group and R and n is as defined above; and m is 0 to 4. Preferably, the substituent R is independently selected from a substituted or unsubstituted alkyl, ether, cycloalkyl, aryl, alkylaryl, hydroxy, carboxylic acid, nitro, halogen, heteroaromatic, or two R substituent forms an aromatic or aliphatic or unsaturated ring; n is 0 to 4; and wherein m+n is 1 to 5.

Substituents on R or B can include any substituent that does not adversely affect the activating agent function, for example, a halogen. The substituents R or B can also comprise another phenolic group.

In one embodiment, the phenolic compound preferably has a melting point of at least 80° C., preferably 80° C. to 300° C., more preferably between 100 and 250° C. Preferably, m+n is 1 or 2. In one embodiment, when m is 0, there is a second phenolic group on an R substituent. It is noted that two bulky alkyl (for example, tertiary $C_4$) substituents ortho to the phenolic group may reduce the effectiveness of the activating agent.

Preferably, the phenolic compound is represented by the following structure:

(VI)

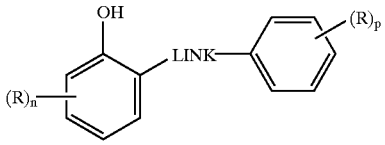

wherein LINK can be —C(=O)NH—, —NHC(=O)—, —NHSO$_2$—, —C(=O)—, —C(=O)O—, —O—, —SO$_2$NH—, and —SO$_2$—, wherein R and n are as defined above, and p is 0 to 4. Preferably R is independently selected from substituted or unsubstituted alkyl, preferably a C1 to C10 alkyl group. In one embodiment n and p are independently 0 or 1. In another embodiment, n+p=1.

Typically, the activating agent is present in an imaging layer of the photothermographic element in the amount of 0.01 times to 0.5 times the amount by weight of coated gelatin per square meter.

As will be appreciated by the skilled artisan, many phenolic activating agents according to the present invention may be made by simple reactions between appropriate intermediates, for example, activating agent A-2 can be prepared by treating 4-methyl salicylic acid with aniline. Methods for synthesizing phenolic compounds according to the present invention can be found in a variety of patent or literature references. For example, synthetic methods for making hydroxynaphthoic acid derivatives are disclosed by Ishida, Katsuhiko; Nojima, Masaharu; Yamamoto, Tamotsu; and Okamoto, Tosaku in Japanese Patent JP 61041595 A2 (1986) and JP 04003759 (1992) and Japanese Kokai JP 84-163718 (1984). Synthetic methods for making N-Substituted salicylamides are disclosed by Ciampa, Giuseppe and Grieco, Ciro., Univ. Naples, Rend. Accad. Sci. Fis. Mat. (Soc. Naz. Sci., Lett. Arti Napoli) (1966), 33(Dec.), 396–403.

Methods for the preparation of the anilides of phenolcarboxylic acids are disclosed by Burmistrov, S. I. and Limarenko, L. I., in U.S.S.R. Patent SU 189869 (1966) and Application SU 19660128. For example, anilides were prepared by treating phenolates with phenylurethane in a high-boiling organic solvent, e.g., cumene or the diethylbenzene fraction from the production of PhEt, with heating. Such a method can be used in the synthesis of activating agent A-2 above.

A Friedel-Crafts reaction, involving the synthesis of salicylanilides via ortho-aminocarbonylation of phenols with phenyl isocyanate can be used in the synthesis of activating agents A-11 and A-12 above. Such a method is reported by Balduzzi, Gianluigi; Bigi, Franca; Casiraghi, Giovanni; Casnati, and Giuseppe; Sartori, Giovanni, Ist. Chim. Org., Univ. Parma, Parma, Italy, in the journal *Synthesis* (1982), (10), 879–81. For example, the reaction of"a" below with PhNCO in the presence of $AlCl_3$ in xylene gave "b," where R, $R^1$, $R^2$, $R^3$=H, H, H, H or Me, H, H, H or H, H, Me, H or H, MeO, H, H or H, H, MeO, H or H, Me, H, Me, or H, OH, H, H or H, H, $R^2R^3$=$(CH{:}CH)_2$.

(a)

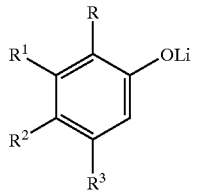

(b)

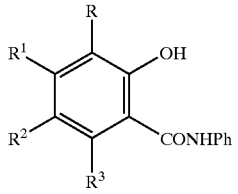

Methods of preparing bisphenol compounds are disclosed in Japanese Patent JP 56108759 A2 (1981) and Application: JP 80-8234 (1980). For example, bisphenol disulfonamides were prepared from bis(benzotriazolyl sulfonates). Thus, in one case, bis(1-benzotriazolyl) diphenyl ether-4,4'-disulfonate was added to 4-aminophenol in pyridine with ice cooling and the mixture stirred 24 hours at room temperature to give N,N'-bis(p-hydroxyphenyl)diphenyl ether-4,4'-disulfonamide. Such methods can be used, for example, to make activating agent A-15 above and the like.

After image-wise exposure of the imaging element, the blocked developer is activated during processing of the imaging element by the presence of acid or base in the processing solution, by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure,* September 1996, Number 389, Item 38957 (hereafter referred to as ("*Research Disclosure I*"). All sections referred to herein are sections of *Research Disclosure I*, unless otherwise indicated. *Research Disclosure I*, Such chemicals include, for example, sulfites, hydroxyl amine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

The blocked compounds may be used in any form of photographic system. A typical color negative film construction useful in the practice of the invention is illustrated by the following element, SCN-1:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly (ethyleneterephthalate) film, poly(ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure I.*

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically contemplated. The grains preferably form surface latent images so that they produce negative images when processed in a surface developer in color negative film forms of the invention.

Illustrations of conventional radiation-sensitive silver halide emulsions are provided by *Research Disclosure I*, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure I*, cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure I*, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure, I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be less than 10 g/m$^2$ of silver. Silver quantities of less than 7 g/m$^2$ are preferred, and silver quantities of less than 5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.5 g of coated silver per m$^2$ of support surface area in the element is necessary to realize an exposure latitude of at least 2.7 log E while maintaining an adequately low graininess position for pictures intended to be enlarged.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure I*, cited above, X. Dye image formers and modifiers, B. Image-dye-forming couplers. The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them.

In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure I*, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure I*, Section VIII. Absorbing and scattering materials, B. Absorbing materials. In elements of the instant invention, magenta colored filter materials are absent from IL2 and RU.

The antihalation layer unit AHU typically contains a light absorbing material that can be removed or decolorized during processing, such as one or a combination of pigments and dyes. Suitable materials can be selected from among those disclosed in *Research Disclosure I*, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure I*, Section IX. Coating physical property modifying addenda. The SOC overlying the emulsion layers additionally preferably contains an ultraviolet absorber, such as illustrated by *Research Disclosure I*, Section VI, UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. The invention can be suitably applied to conventional color negative construction as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta \log E$) by doubling changes in density ($\Delta D$). Thus, gamma's as low as 1.0 or even 0.6 are contemplated and exposure latitudes of up to about 5.0 log E or higher are feasible. Gammas of about 0.55 are preferred. Gammas of between about 0.4 and 0.5 are especially preferred.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure I*, Section X. Dye image formers and modifiers, A. Silver dye bleach.

It is also well known that pre-formed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure*, Vol. 151, November 1976, Item 15162.

It is also recognized that the dye image can be provided by compounds that are initially mobile, but are rendered immobile during imagewise development. Image transfer systems utilizing imaging dyes of this type have long been used in previously disclosed dye image transfer systems. These and other image transfer systems compatible with the practice of the invention are disclosed in *Research Disclosure*, Vol. 176, December 1978, Item 17643, XXIII. Image transfer systems.

A number of modifications of color negative elements have been suggested for accommodating scanning, as illustrated by *Research Disclosure I*, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image which, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element of the invention may also be a black and white image-forming material comprised, for example, of a pan-sensitized silver halide emulsion and a developer of the invention. In this embodiment, the image may be formed by developed silver density following processing, or by a coupler that generates a dye which can be used to carry the neutral image tone scale.

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al, U.S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. Nos. 4,890,130 and 5,063,400; providing an electronic flash means as described at Ohmura et al, U.S. Pat. No. 4,896,178;

providing an externally operable member for effecting exposure as described at Mochida et al, U.S. Pat. No. 4,954,857; providing film support with modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221. More generally, the size limited cameras most useful as one-time-use cameras will be generally rectangular in shape and can meet the requirements of easy handling and transportability in, for example, a pocket, when the camera as described herein has a limited volume. The camera should have a total volume of less than about 450 cubic centimeters (cc's), preferably less than 380 cc, more preferably less than 300 cc, and most preferably less than 220 cc. The depth-to-height-to-length proportions of such a camera will generally be in an about 1:2:4 ratio, with a range in each of about 25% so as to provide comfortable handling and pocketability. Generally the minimum usable depth is set by the focal length of the incorporated lens and by the dimensions of the incorporated film spools and cartridge. The camera will preferably have the majority of corners and edges finished with a radius-of-curvature of between about 0.2 and 3 centimeters. The use of thrust cartridges allows a particular advantage in this invention by providing easy scanner access to particular scenes photographed on a roll while protecting the film from dust, scratches, and abrasion, all of which tend to degrade the quality of an image.

While any known taking lens may be employed in the cameras of this invention, the taking lens mounted on the single-use cameras of the invention are preferably single aspherical plastic lenses. The lenses will have a focal length between about 10 and 100 mm, and a lens aperture between f/2 and f/32. The focal length is preferably between about 15 and 60 mm and most preferably between about 20 and 40 mm. For pictorial applications, a focal length matching to within 25% the diagonal of the rectangular film exposure area is preferred. Lens apertures of between f/2.8 and f/22 are contemplated with a lens aperture of about f/4 to f/16 being preferred. The lens MTF can be as low as 0.6 or less at a spatial frequency of 20 lines per millimeter (1 pm) at the film plane, although values as high as 0.7 or most preferably 0.8 or more are contemplated. Higher lens MTF values generally allow sharper pictures to be produced. Multiple lens arrangements comprising two, three, or more component lens elements consistent with the functions described above are specifically contemplated.

Cameras may contain a built-in processing capability, for example a heating element. Designs for such cameras including their use in an image capture and display system are disclosed in U.S. patent application Ser. No. 09/388,573 filed Sep. 1, 1999, incorporated herein by reference. The use of a one-time use camera as disclosed in said application is particularly preferred in the practice of this invention.

Photographic elements of the present invention are preferably imagewise exposed using any of the known techniques, including those described in *Research Disclosure I*, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

The elements as discussed above may serve as origination material for some or all of the following processes: image scanning to produce an electronic rendition of the capture image, and subsequent digital processing of that rendition to manipulate, store, transmit, output, or display electronically that image.

The blocked compounds of this invention may be used in photographic elements that contain any or all of the features discussed above, but are intended for different forms of processing. These types of systems will be described in detail below.

Type I: Thermal process systems (thermographic and photothermographic), where processing is initiated solely by the application of heat to the imaging element.

Type II: Low volume systems, where film processing is initiated by contact to a processing solution, but where the processing solution volume is comparable to the total volume of the imaging layer to be processed. This type of system may include the addition of non solution processing aids, such as the application of heat or of a laminate layer that is applied at the time of processing.

Type III: Conventional photographic systems, where film elements are processed by contact with conventional photographic processing solutions, and the volume of such solutions is very large in comparison to the volume of the imaging layer.

Type I: Thermographic and Photothermographic Systems

In accordance with one aspect of this invention the blocked developer is incorporated in a photothermographic element. Photothermographic elements of the type described in *Research Disclosure* 17029 are included by reference. The photothermographic elements may be of type A or type B as disclosed in *Research Disclosure* 17029. Type A elements contain in reactive association a photosensitive silver halide, a reducing agent or developer, an activator, and a coating vehicle or binder. In these systems development occurs by reduction of silver ions in the photosensitive silver halide to metallic silver. Type B systems can contain all of the elements of a type A system in addition to a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992.

The photothermographic element comprises a photosensitive component that consists essentially of photographic silver halide. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of mercapto or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, tetrazole, oxazole, thiazole, thiazoline,, imidazoline, imidazole, diazole, pyridine and triazine. Preferred examples of these heterocyclic compounds include a silver salt of 3-mercapto-4-phenyl-1,2,4 triazole, a silver salt of 1-phenyl-5-mercaptotetrazole, a silver salt of 2-mercaptobenzimidazole, a silver salt of 2-mercapto-5-aminothiadiazole, a silver salt of 2-(2-ethyl-glycolamido) benzothiazole, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1, 2,4-thiazole, a silver salt of a thione compound such as a silver salt of 3-(2-carboxyethyl)-4-methyl-4-thiazoline-2-thione as disclosed in U.S. Pat. No. 3,201,678. Examples of other useful mercapto or thione substituted compounds that do not contain a heterocyclic nucleus are illustrated by the following: a silver salt of thioglycolic acid such as a silver salt of a S-alkylthioglycolic acid (wherein the alkyl group has from 12 to 22 carbon atoms) as described in Japanese patent application 28221/73, a silver salt of a dithiocarboxylic acid such as a silver salt of dithioacetic acid, and a silver salt of thioamide.

Furthermore, a silver salt of a compound containing an imino group can be used. Preferred examples of these compounds include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

It is also found convenient to use silver half soap, of which an equimolar blend of a silver behenate with behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used. A method for making silver soap dispersions is well known in the art and is disclosed in *Research Disclosure* October 1983 (23419) and U.S. Pat. No. 3,985,565.

Silver salts complexes may also be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

A reducing agent in addition to the blocked developer may be included. The reducing agent for the organic silver salt may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis (ethoxyethyl)hydroxylamine, piperidinohexose reductone or formyl-4-methylphenylhydrazine, hydroxamic acids such as phenylhydroxamic acid, p-hydroxyphenyl-hydroxamic acid, and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl αcyano-2-methylphenylacetate, ethyl α-cyano-phenylacetate; bis-β-naphthols as illustrated by 2,2'-dihydroxyl-1-binaphthyl, 6,6'-dibromo-2,2'-dihydroxy- 1,1'-binaphthyl, and bis(2-hydroxy-1-naphthyl) methane; a combination of bis-β-naphthol and a 1,3-dihydroxybenzene derivative, (e. g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfon-amido-phenol, and p-benzenesulfonamidophenol; 2-phenylindane-1, 3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bisphenols, e.g., bis(2-hydroxy-3-t-butyl-5-methylphenyl)-methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; pyrazolidin-3-ones; and certain indane-1,3-diones.

An optimum concentration of organic reducing agent in the photothermographic element varies depending upon such factors as the particular photothermographic element, desired image, processing conditions, the particular organic silver salt and the particular oxidizing agent.

The photothermographic element can comprise a toning agent, also known as an activator-toner or toner-accelerator. Combinations of toning agents are also useful in the photothermographic element. Examples of useful toning agents and toning agent combinations are described in, for example, *Research Disclosure*, June 1978, Item No. 17029 and U.S. Pat. No. 4,123,282. Examples of useful toning agents include, for example, phthalimide, N-hydroxyphthalimide, N-potassium-phthalimide, succinimide, N-hydroxy- 1,8-naphthalimide, phthalazine, 1-(2H)-phthalazinone, 2-acetylphthalazinone, salicylanilide, benzamide, and dimethylurea.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

Imagewise exposure is preferably for a time and intensity sufficient to produce a developable latent image in the photothermographic element.

After imagewise exposure of the photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed in commonly assigned, co-pending U.S. patent applications Ser. Nos. 09/206586, 09/206,612, and 09/206,583 filed Dec. 7, 1998, which are incorporated herein by reference. The use of an apparatus whereby the processor can be used to write information onto the element, information which can be used to adjust processing, scanning, and image display is also envisaged. This system is disclosed in U.S. patent applications Ser. Nos. 09/206,914 filed Dec. 7, 1998 and 09/333,092 filed Jun. 15, 1999, which are incorporated herein by reference.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

In accordance with one aspect of this invention the blocked PUG is incorporated in a thermographic element, in which the PUG can be a developer or a preformed leuco or shifted dye. In thermographic elements an image is formed by imagewise heating the element. Such elements are described in, for example, *Research Disclosure*, Jun. 1978, Item No. 17029 and U.S. Pat. Nos. 3,080,254, 3,457,075 and 3,933,508, the disclosures or which are incorporated herein by reference. The thermal energy source and means for imaging can be any imagewise thermal exposure source and means that are known in the thermographic imaging art. The thermographic imaging means can be, for example, an infrared heating means, laser, microwave heating means or the like.

Type II: Low Volume Processing

In accordance with another aspect of this invention the blocked developer is incorporated in a photographic element intended for low volume processing. Low volume processing is defined as processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume processing system may contain any of the elements described above for Type I: Photothermographic systems. In addition, it is specifically contemplated that any components described in the preceding sections that are not necessary for the formation or stability of latent image in the origination film element can be removed from the film element altogether and contacted at any time after exposure for the purpose of carrying out photographic processing, using the methods described below.

The Type II photographic element may receive some or all of the following treatments:

(I) Application of a solution directly to the film by any means, including spray, inkjet, coating, gravure process and the like.

(II) Soaking of the film in a reservoir containing a processing solution. This process may also take the form of dipping or passing an element through a small cartridge.

(III) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a image-wise manner to the auxiliary processing element.

(IV) Heating of the element by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C.

Type III: Conventional Systems

In accordance with another aspect of this invention the blocked developer is incorporated in a conventional photographic element.

Conventional photographic elements in accordance with the invention can be processed in any of a number of well-known photographic processes utilizing any of a number of well-known conventional photographic processing solutions, described, for example, in *Research Disclosure I*, or in T. H. James, editor, *The Theory of the Photographic Process,* 4th Edition, Macmillan, N.Y., 1977. The development process may take place for any length of time and any process temperature that is suitable to render an acceptable image. In these cases the presence of blocked developers of the invention may be used to provide development in one or more color records of the element, supplementary to the development provided by the developer in the processing solution to give improved signal in a shorter time of development or with lowered laydowns of imaging materials, or to give balanced development in all color records. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(2-(methanesulfonamido) ethylaniline sesquisulfate hydrate, 4-amino-3-methyl-N-ethyl-N-(2-hydroxyethyl)aniline sulfate, 4-amino-3-α-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822, 129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development may be followed by bleach-fixing, to remove silver or silver halide, washing and drying.

Once yellow, magenta, and cyan dye image records have been formed in the processed photographic elements of the invention, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. The signal transformation techniques of Giorgianni et al '030 described in connection with FIG. 8 represent a specifically preferred technique for obtaining a color balanced image for viewing. Further illustrations of the capability of those skilled in the art to manage color digital image information are provided by Giorgianni and Madden *Digital Color Management*, Addison-Wesley, 1998.

EXAMPLE 1

Film coating examples were prepared on a 7 mil thick poly(ethylene terephthalate) support and comprised a layer containing phenolic activating agent and the blocked compound (with contents shown below) with an overcoat layer of gelatin (0.22 g/m$^2$) and 1,1'-(methylenebis(sulfonyl))bisethene hardener (at 2% of the total gelatin concentration). Both layers contained spreading aids to facilitate coating.

| Component | Laydown |
|---|---|
| Blocked Developer | 2.69 mMole/m$^2$ |
| Activating Agent | 0.86 g/m$^2$ |
| Lime processed gelatin | 4.3 g/m$^2$ |

For comparison purposes, a comparative Blocked Developer (DC-1) represented by the following structure was tested:

DC-1

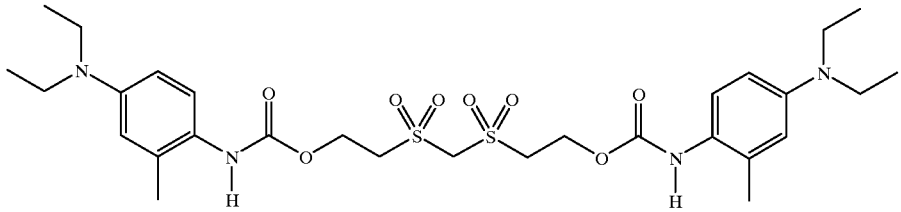

The material was ball-milled in an aqueous mixture, for 4 days using Zirconia beads in the following formula. For 1 g of Incorporated developer, sodium tri-isopropylnaphthalene sulfonate (0.1 g), water (to 10 g), and beads (25 mL), were used. In some cases, after milling, the slurry was diluted with warmed (40° C.) gelatin solution (12.5%, 10 g) before the beads were removed by filtration. The filtrate (with or without gelatin addition) was stored in a refrigerator prior to use.

The incorporated developers (D-1, D-2, D-3, D-4) had the following structures:

D-1

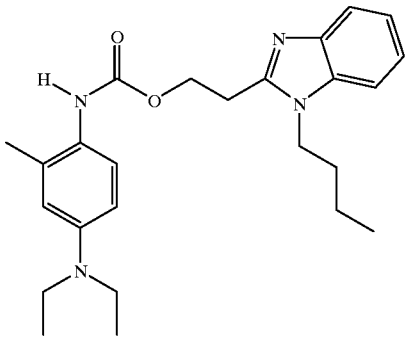

D-2

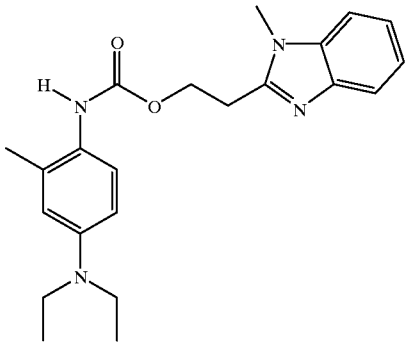

D-3

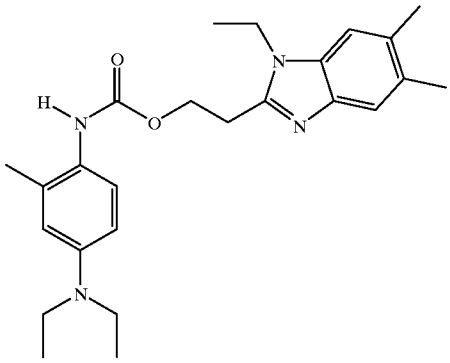

-continued

D-4

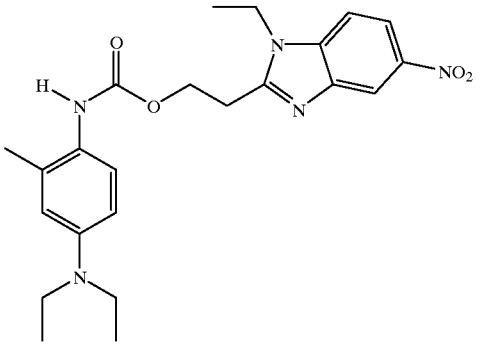

The above compounds were incorporated in the same way as for DC-1.

For comparison to the activating agents of the present invention, the comparative compounds were as follows:

AC-1

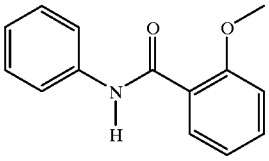

AC-2

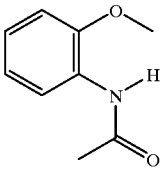

AC-3

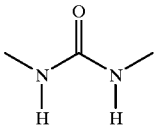

AC-4

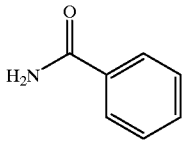

Film Evaluation

The different coatings were heated at specified temperatures for 20 sec and a punch of each of the processed films was digested with 0.5 mL aqueous Protease solution (1 mg/mL) at 40° C. and then treated with 1.0 mL of tetrahydrofuran (THF) solvent (with 1% acetic acid). The mixture was filtered and analyzed with a reversed-phase high performance liquid chromatography (HPLC), e.g., a Hewlett-Packard 1100 IPLC system. The amount of blocked compound recovered after the processing treatment is reported as percentage of that found in the unprocessed film, which is used as a reference, as shown below.

| | | Percent Blocked Developer Recovered (20 sec) | | | |
|---|---|---|---|---|---|
| Developer | Activ. | 130° C. | 140° C. | 150° C. | 160° C. |
| DC-1 | None | NR | 86.8% | 85.4% | 83.4% |
| DC-1 | A-1 | 94.8% | 85.7% | 83.7% | 56.5% |
| D-2 | None | NR | 93.3% | 89.4% | 88.1% |
| D-2 | A-1 | 58.8% | 34.1% | 9.2% | 0.1% |
| D-3 | none | 89.3% | NR | NR | NR |
| D-4 | none | NR | NR | NR | NR |

No reaction detected (NR) was assigned for experiments in which 95% or more of the blocked developer remained. It is seen from the tabulated results that A-1 has a profound effect on the thermolysis of D-2, whereas its effect on the comparative DC-1 is relatively small. Also the inventive blocked compounds D-3 and D-4 are essentially like D-2 which is non-reactive without the melt-former A-1.

EXAMPLE 2

In this example the effect of the activating agent is evaluated. A-3 is incorporated into the coating melt as an aqueous solution with the same laydown as the solid particle A-1. After processing and analysis the following is obtained, which shows that with the inventive blocked compounds only the phenolic activating agent A-1 has a significant effect on their thermolyses.

| | | Percent of Blocked Dev. Recovered After 20 sec | | | |
|---|---|---|---|---|---|
| Dev. | Activ. | 130° C. | 140° C. | 150° C. | 160° C. |
| DC-1 | AC-3 | 88.5% | 83.7% | 83.1% | 62.9% |
| D-1 | AC-3 | NR | NR | NR | 85.3% |
| D-1 | A-1 | 61.0% | 34.8% | 13.1% | 0.1% |
| D-2 | AC-3 | NR | NR | 89.4% | 84.9% |
| D-4 | AC-3 | 92.9% | 94.1% | 93.9% | 92.0% |

EXAMPLE 3

This example compares a soluble phenolic activator (A-18) with a solid particle non-phenolic compound (AC-4). After the same processing and analysis as in Example 1, the following table is obtained which indicates that the phenolic activator A-18 is more active than the comparative compound when present with the inventive blocked compounds.

| | | Percent of Blocked Dev. Recovered After 20 s | | | |
|---|---|---|---|---|---|
| Dev. | Activ. | 130° C. | 140° C. | 150° C. | 160° C. |
| DC-1 | AC-4 | 90.5% | 92.6% | 87.7% | 79.2% |
| DC-1 | A-18 | 71.6% | 58.9% | 37.4% | 64.0% |

-continued

| | | Percent of Blocked Dev. Recovered After 20 s | | | |
|---|---|---|---|---|---|
| Dev. | Activ. | 130° C. | 140° C. | 150° C. | 160° C. |
| D-1 | AC-4 | NR | 93.3% | 90.3% | 87.3% |
| D-1 | A-18 | 74.8% | 56.4% | 33.3% | 36.0% |
| D-2 | AC-4 | 91.2% | 91.5% | 84.7% | 76.6% |
| D-2 | AF-18 | 71.6% | 50.4% | 31.1% | 14.0% |

EXAMPLE 4

In this example structures similar to A-1 were used. The coatings were prepared like in example 1 except equimolar amounts of A-2, A-3, A-4, and A-5 were added in place of A-1. Same treatment and analysis of these coatings gave results listed in the following table. Again, the thermolysis of D-2 in the film environment is strongly facilitated by the presence of these phenolic compounds as can be clearly seen in the table.

| | | Percent of Blocked Dev. Recovered After 20 s | | | |
|---|---|---|---|---|---|
| Dev. | Activ. | 130° C. | 140° C. | 150° C. | 160° C. |
| D-2 | A-1 | 50.3% | 32.0% | 14.2% | 0.0% |
| D-2 | A-2 | 87.2% | 44.3% | 13.0% | 3.5% |
| D-2 | A-5 | NR | 94.5% | 30.9% | 6.5% |
| D-2 | A-3 | 70.2% | 42.6% | 17.1% | 3.1% |
| D-2 | A-4 | 94.6% | 61.8% | 14.2% | 4.6% |

Although the invention has been illustrated with these specific examples involving developers, it is clearly applicable to the thermal release of other types of photographically useful groups.

EXAMPLE 5

The following further demonstrate the interaction between the phenolic melt-formers and the blocked compounds in a solution environment. In these experiments, an activating agent was dissolved at 0.010 M (10 mM) in anhydrous dimethylsulfoxide (DMSO) solvent that had been heated to 130° C. The blocked compound, D-1 (in DMSO, 0.2 M), was then added so that in the reaction mixture its concentration was 0.0001 M. The reaction mixture was analyzed at various time intervals with a HPLC system (HEWLETT-PACKARD 1100). The rate constant (k) of decay of D-1 under the conditions was obtained by plotting the logarithm of its HPLC area vs. time. The half-lives ($t_{1/2}$) were calculated as:

$$t_{1/2} = \frac{\ln 2}{k}$$

The results are listed in the following table. It is obvious that the potential activating agent with a phenolic group enhance the reaction of D-1 while the comparative compound AC-2 shows no significant effect.

Half-life of D-1 in DMSO (130° C.):

| Containing Activ. (10 mM) | $t_{1/2}$, min |
|---|---|
| A-1 | 62.4 |
| A-2 | 57.3 |
| A-3 | 72.2 |
| A-4 | 83.5 |
| A-5 | 75.3 |
| A-8 | 29.0 |
| A-19 | 29.4 |
| A-9 | 133.3 |
| A-7 | 277.3 |
| A-10 | 83.5 |
| A-16 | 14.6 |
| A-6 | 27.5 |
| None | >1000 |
| AC-2 | 938.2 |

The invention has been described in detail with particular reference to preferred embodiments, but it will be understood that variations and modifications can be effected within the spirit and scope of the invention.

What is claimed is:

1. An imaging element comprising an imaging layer having associated therewith a blocked color-forming agent in association with a phenolic activating agent, wherein the blocked color forming agent is represented by Structure I:

(I)

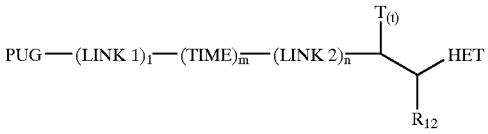

wherein

PUG is a photographically useful group that is a color-forming agent;

TIME is a timing group;

T represents t independently selected substituted or unsubstituted alkyl or aryl groups, t is 0, 1, or 2 and if t is 2, the T groups can form a ring;

HET is a heterocyclic group which optionally can form a ring with a T group;

$R_{12}$ is hydrogen, substituted or unsubstituted alkyl or substituted or unsubstituted aryl, or $R_{12}$ can form a ring with a T group or with HET;

l is 0 or 1;

m is 0, 1, or 2; and n is 0 or 1;

where LINK 1 and LINK 2 are independently of Structure II:

II

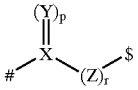

wherein

X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2);

wherein the phenolic activating agent for unblocking the color-forming agent of Structure I is represented by the following Structure IV:

$$Ar—(OH)_q \quad (IV)$$

wherein $q \geqq 1$ and Ar is a substituted or unsubstituted aromatic group.

2. An imaging element according to claim 1, wherein PUG is a coupler, development inhibitor, inhibitor releasing developer, dye or dye precursor, developing agent, or precursors thereof.

3. An imaging element according to claim 2, wherein PUG is a developer.

4. An imaging element according to claim 3, wherein the developer is an aminophenol, phenylenediamine, hydroquinone, pyrazolidinone, or hydrazine.

5. An imaging element according to claim 4, wherein the developer is a phenylenediamine.

6. An imaging element according to claim 1, where LINK 1 and LNK 2 are the following:

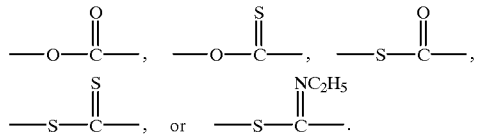

7. An imaging element according to claim 6, wherein LINK 1 is

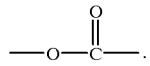

8. An imaging element according to claim 1, wherein TIME is a timing group selected from (1) groups utilizing an aromatic nucleophilic substitution reaction;

(2) groups utilizing the cleavage reaction of a hemiacetal;

(3) groups utilizing an electron transfer reaction along a conjugated system; or (4) groups using an intramolecular nucleophilic substitution reaction.

9. An imaging element according to claim 1, wherein HET is selected from substituted or unsubstituted benzimidazolyl, benzothiazolyl, benzoxazolyl, benzothiophenyl, benzofuryl, furyl, imidazolyl, indazolyl, indolyl, isoquinolyl, isothiazolyl, isoxazolyl, oxazolyl, picolinyl, purinyl, pyranyl, pryazinyl, pyrazolyl, pyridyl, pyrimidinyl, pyrrolyl, quinaldinyl, quinazolinyl, quinolyl, quinoxalinyl, tetrazolyl, thiadiazolyl, thiatriazolyl, thiazolyl, thiophenyl, and triazolyl group.

10. An imaging element according to claim 9, wherein HET comprises a substituted or unsubstituted 2-imidazolyl, 2-benzimidazolyl, 2-thiazolyl, 2-benzothiazolyl, 2-oxazolyl, 2-benzoxazolyl, 2-pyrydyl, 2-quinolinyl, 1-isoquinolinyl, 2-pyrrolyl, 2-indolyl, 2-thiophenyl, 2-benzothiophpenyl, 2-furyl, 2-benzofuryl, 2-,4-, or 5-pyrimidinyl, 2-pyrazinyl, 3-,4-, or 5-pyrazolyl, 3-indazolyl, 2-(1,3,4-triazolyl), 4-or 5-(1,2,3-triazolyl), 5-(1,2,3,4-tetrazolyl) group.

11. An imaging element according to claim 1, wherein the compound of Structure I is of Structure III:

III

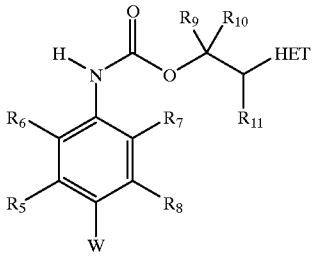

(III)

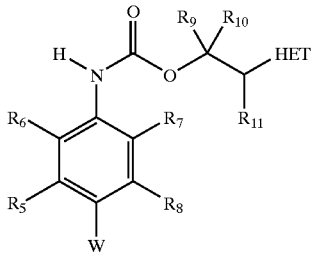

wherein:

HET is a heterocyclic group;

W is OH or $NR_2R_3$, and $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or $R_6$ and/or $R_8$ can connect to $R_4$ or $R_7$ to form a ring;

$R_9$, $R_{10}$ and $R_{11}$ are independently hydrogen, alkyl, aryl, heteroaromatic or alkoxy groups, or any two of $R_9$, $R_{10}$, $R_{11}$ and HET can be connected to form a ring.

12. An imaging element according to claim 11, wherein HET comprises a substituted or unsubstituted benzimidazolyl, benzothiazolyl, benzoxazolyl, benzothiophenyl, benzofuryl, furyl, imidazolyl, indazolyl, indolyl, isoquinolyl, isothiazolyl, isoxazolyl, oxazolyl, picolinyl, purinyl, pyranyl, pyrazinyl, pyrazolyl, pyridyl, pyrimidinyl, pyrrolyl, quinaldinyl, quinazolinyl, quinolyl, quinoxalinyl, tetrazolyl, thiadiazolyl, thiatriazolyl, thiazolyl, thiophenyl, or triazolyl group.

13. An imaging element according to claim 12, wherein HET is a 2-imidazolyl, 2-benzimidazolyl, 2-thiazolyl, 2-benzothiazolyl, 2-oxazolyl, 2-benzoxazolyl, 2-pyridyl, 2-quinolinyl, 1-isoquinolinyl, 2-pyrrolyl, 2-indolyl, 2-thiophenyl, 2-benzothiophenyl, 2-furyl, 2-benzofuryl, 2-,4-, or 5-pyrimidinyl, 2-pyrazinyl, 3-,4-, or 5-pyrazolyl, 3-indazolyl, 2-(1,3,4-triazolyl), 4-or 5-(1,2,3-triazolyl), or 5-(1,2,3,4-tetrazolyl) group.

14. An imaging element according to claim 1 wherein the phenolic activating agent has the following structure:

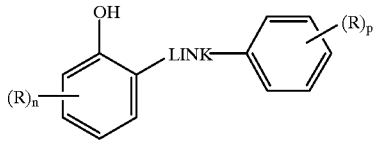

wherein LINK is selected from the group consisting of —C(=O)NH—, —NHC(=O)—, —$NHSO_2$—, —C(=O)—, —O—, —C(=O)O—, —$SO_2NH$—, and —$SO_2$—;

wherein the substituent R is independently selected from a substituted or unsubstituted alkyl, ether, cycloalkyl, aryl, alkylaryl, hydroxy, carboxylic acid, nitro, halogen, heteroaromatic, or wherein two R substituents form an aromatic or aliphatic or unsaturated ring;

p is 0 to4;

n is 0 to 4; and wherein p+n is 1 to 5.

15. An imaging element according to claim 1 wherein the phenolic activating agent has the following structure:

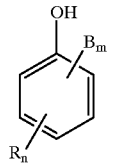

wherein B is selected from the group consisting of —C(=O)$NHR^3$, —NHC(=O)$R^3$, —$NHSO_2R^3$, —C(=O)$R^3$, —C(=O)$OR^3$, —$OR^3$, —$SO_2NHR^3$, and —$SO_2R^3$;

where $R^3$ is hydrogen or substituted or unsubstituted alkyl group; and m is 0 to 4;

wherein the substituent R is independently selected from a substituted or unsubstituted alkyl, ether, cycloalkyl, aryl, alkylaryl, hydroxy, carboxylic acid, nitro, halogen, heteroaromatic, or wherein two R substituents form an aromatic or aliphatic or unsaturated ring;

n is 0 to 4; and, wherein m+n is 1 to 5.

16. An imaging element according to claim 14 wherein R is independently selected from substituted or unsubstituted $C_1$ to $C_{10}$ alkyl group.

17. The color photothermographic element of claim 1 in which the phenolic compound is present in the amount of 0.01 times to 0.5 times the amount by weight of coated gelatin per square meter.

18. An imaging element according to claim 1, wherein the compound of Structure I and IV are in the imaging layer.

19. An imaging element according to claim 1 which is a photothermographic element.

20. An imaging element according to claim 19, wherein the photothermographic element contains an imaging layer comprising a light sensitive silver halide emulsion, a non-light sensitive silver salt oxidizing agent and a reducing agent.

21. An imaging element according to claim 1, which is a photographic element.

22. An imaging element according to claim 21, wherein the photographic element contains an imaging layer comprising a light sensitive silver halide emulsion.

23. An imaging element according to claim 1, wherein the imaging element is a thermographic imaging element.

24. An imaging element according to claim 23, wherein the thermographic imaging element contains an imaging layer comprising a non-light sensitive silver salt oxidizing agent and a reducing agent.

25. An imaging element according to claim 23, wherein the thermographic imaging element contains an imaging layer comprising a releasable dye or dye precursor and a phenolic activating agent.

26. A method of image formation comprising the step of developing an imagewise exposed imaging element according to claim 1.

27. A method according to claim 26, wherein said developing comprises treating said imagewise exposed element at a temperature between about 90° C. and about 180° C. for a time ranging from about 0.5 to about 60 seconds.

28. A method according to claim 26, wherein said developing comprises treating said imagewise exposed element to a volume of processing solution is between about 0.1 and about 10 times the volume of solution required to fully swell the photographic element.

29. A method according to claim 28, wherein the developing is accompanied by the application of a laminate sheet containing additional processing chemicals.

30. A method according to claim 28, wherein the developing is conducted at a processing temperature between about 20° C. and about 100° C.

31. A method according to claim 28, wherein the applied processing solution is a base, acid, or pure water.

32. A method according to claim 26, wherein said developing comprises treating said imagewise element with a conventional photographic processing solution.

33. A method of image formation comprising the step of scanning and imagewise exposed and developed imaging element according to claim 1 to form a first electronic image representation of said imagewise exposure.

* * * * *